US007373979B2

(12) United States Patent
Coronado et al.

(10) Patent No.: US 7,373,979 B2
(45) Date of Patent: May 20, 2008

(54) WORKSTRING AND A METHOD FOR GRAVEL PACKING

(75) Inventors: Martin P. Coronado, Cypress, TX (US); Rami Jasser, Houston, TX (US); John Salerni, Kingwood, TX (US); James R. Zachman, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 196 days.

(21) Appl. No.: 10/999,791

(22) Filed: Nov. 30, 2004

(65) Prior Publication Data

US 2005/0139355 A1 Jun. 30, 2005

Related U.S. Application Data

(60) Provisional application No. 60/530,852, filed on Dec. 18, 2003.

(51) Int. Cl.
*E21B 43/00* (2006.01)

(52) U.S. Cl. ..... 166/278; 166/51

(58) Field of Classification Search ..... 166/278, 166/51, 386, 332.1, 334.1, 334.4
See application file for complete search history.

(56) References Cited

U.S. PATENT DOCUMENTS 3,627,046 A 12/1971 Miller et al. ..... 166/278
3,884,301 A 5/1975 Turner et al. ..... 166/278
4,273,190 A * 6/1981 Baker et al. ..... 166/278
4,522,264 A 6/1985 McNeer ..... 166/278
5,343,949 A * 9/1994 Ross et al. ..... 166/278
6,302,208 B1 * 10/2001 Walker et al. ..... 166/278
6,311,772 B1 * 11/2001 Myhre et al. ..... 166/278
2003/0111224 A1 6/2003 Hailey, Jr. et al. ..... 166/278
2003/0221830 A1 * 12/2003 Leising et al. ..... 166/278

* cited by examiner

*Primary Examiner*—Jennifer H Gay
*Assistant Examiner*—Brad Harcourt
(74) *Attorney, Agent, or Firm*—Cantor Colburn LLP

(57) ABSTRACT

Disclosed is a workstring for use in a gravel packing system. The workstring includes a washpipe with at least one port and a selectively openable and closeable closure mechanism in operable communication with the at least one port.

Further disclosed is a collet having a collet base and a plurality of collet fingers extending from the collet base. At least one of the collet fingers includes retaining feature, the retaining feature being configured to yield under bending at a selected valve.

Yet further disclosed is a method for gravel packing. The method includes gravel packing a wellbore including opening one or more valves in a washpipe as pressure associated with the gravel packing climbs, the valves providing an escape path for a fluid component of the gravel pack to an inside dimension of the washpipe. The method further includes closing the one or more valves in the washpipe.

20 Claims, 9 Drawing Sheets

WORKSTRING AND A METHOD FOR GRAVEL PACKING

CROSS-REFERENCE TO RELATED APPLICATIONS

This application claims the benefit of an earlier filing date from U.S. Ser. No. 60/530,852 filed Dec. 18, 2003, the entire contents of which is incorporated herein by reference.

BACKGROUND

In the hydrocarbon recovery industry, gravel packs have longed been used to help prevent unconsolidated formations from collapsing and occluding a borehole therein while also filtering some of the granular material that would otherwise be entrained with the desired production fluid. As wellbore technology is developed, allowing for multilateral well systems, including highly deviated and even horizontal systems, the hydrocarbon industry has had increasing interest in creating horizontal gravel packs for similar reasons as their vertical predecessors were employed. In some cases, such horizontal gravel packs are extremely long. While the pack itself is still quite capable of performing as intended, an issue presents itself with respect to the formation. When an extremely long gravel pack is created, the fluid pressure developed and applied at surface that is required to continue the gravel packing operation as the pack gets longer and longer is continually higher. At a point, such pressure will be damaging to the formation, which is undesirable. Therefore, it has been discovered that it is desirable to create an auxiliary valve system which shortens the escape path of the gravel pack fluid thereby reducing the overall pressure required to complete the packing operation. A device and method to accomplish shortening of such path is disclosed in U.S. Pat. No. 6,311,772 to Myhre et al. and owned by the assignee hereof, Baker Hughes Incorporated, Houston, Tex. That device functions extraordinarily well for its intended purpose and does indeed reduce pressures substantially, and to well below levels associated with problems for the formation. Unfortunately, however, the device described in the '772 patent also leaves a washpipe that is not capable of conveying fluids to the bottom of the well because it has in general, a plurality of now open valves over its length, those valves having been opened sequentially by pressure activation to shorten the escape path for the gravel pack slurry fluid. Since it is often desirable to provide to the downhole most end of the workstring a stimulation fluid and operator is required to pull the workstring and in another run provide a device capable of conveying the stimulation fluid to the desired location. As one of ordinary skill in the art is all too well aware, additional runs dramatically increase costs of an operation and therefore are to be avoided. A tool capable of providing for a stimulation operation while avoiding the secondary run after the gravel packing operation would certainly be well received by the art.

SUMMARY

Disclosed herein is a workstring for use in a gravel packing system. The workstring includes a washpipe with at least one port and a selectively openable and closeable closure mechanism in operable communication with the at least one port.

Further disclosed herein is a collet having a collet base and a plurality of collet fingers extending from the collet base. At least one of the collet fingers includes retaining feature, the retaining feature being configured to yield under bending at a selected value.

Yet further disclosed herein is a method for gravel packing. The method includes gravel packing a wellbore including opening one or more valves in a washpipe as pressure associated with the gravel packing climbs, the valves providing an escape path for a fluid component of the gravel pack to an inside dimension of the washpipe. The method further includes closing the one or more valves in the washpipe.

BRIEF DESCRIPTION OF THE DRAWINGS

Referring now to the drawings wherein like elements are numbered alike in the several Figures.

DETAILED DESCRIPTION

Figure 1A:
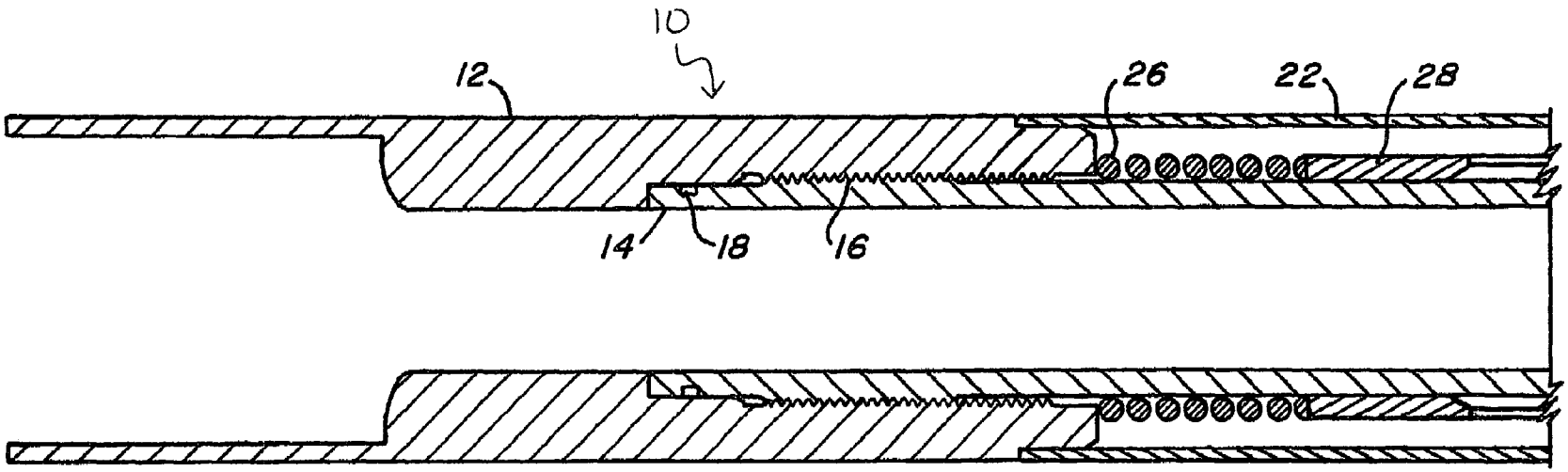
FIGS. 1A-1E are an extended view in cross-section and quarter section of a workstring for a gravel packing operation, the workstring in a run-in position.
Figure 1B:
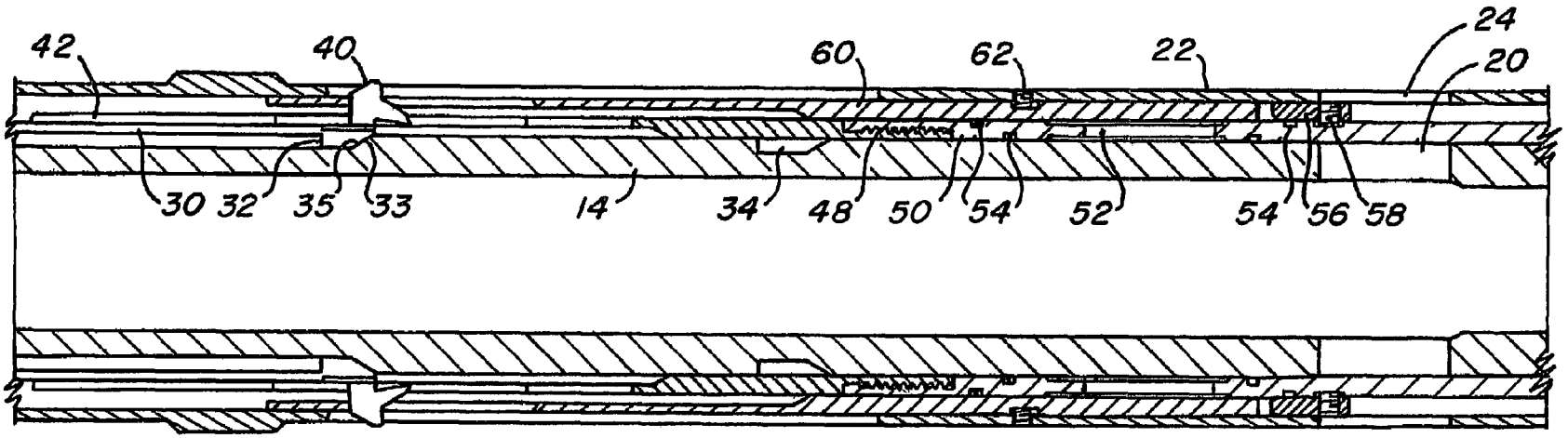
Figure 1C:
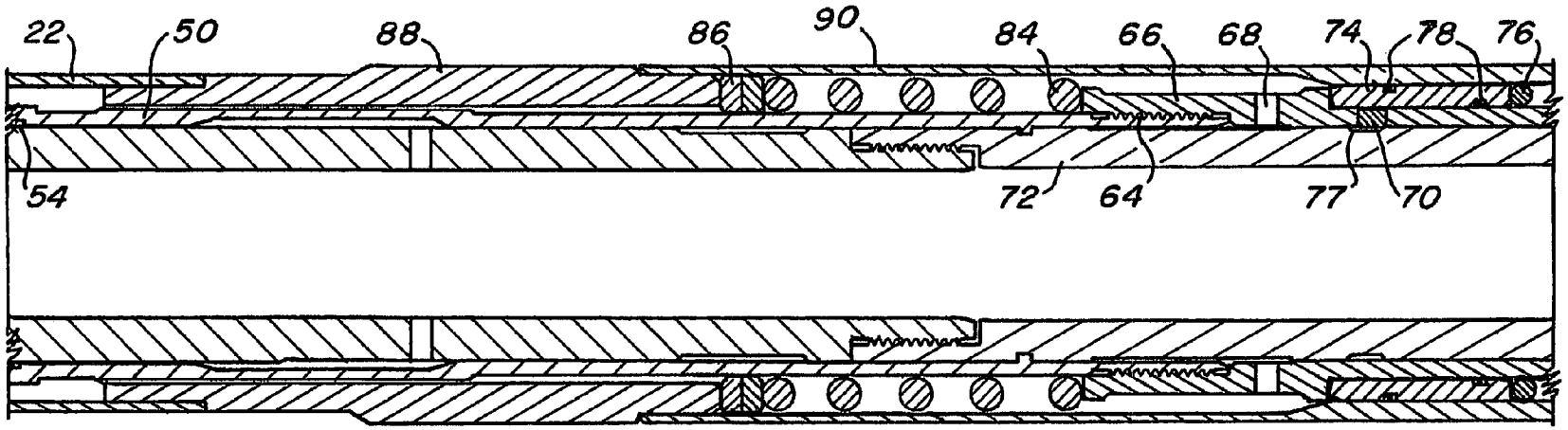
Figure 1D:
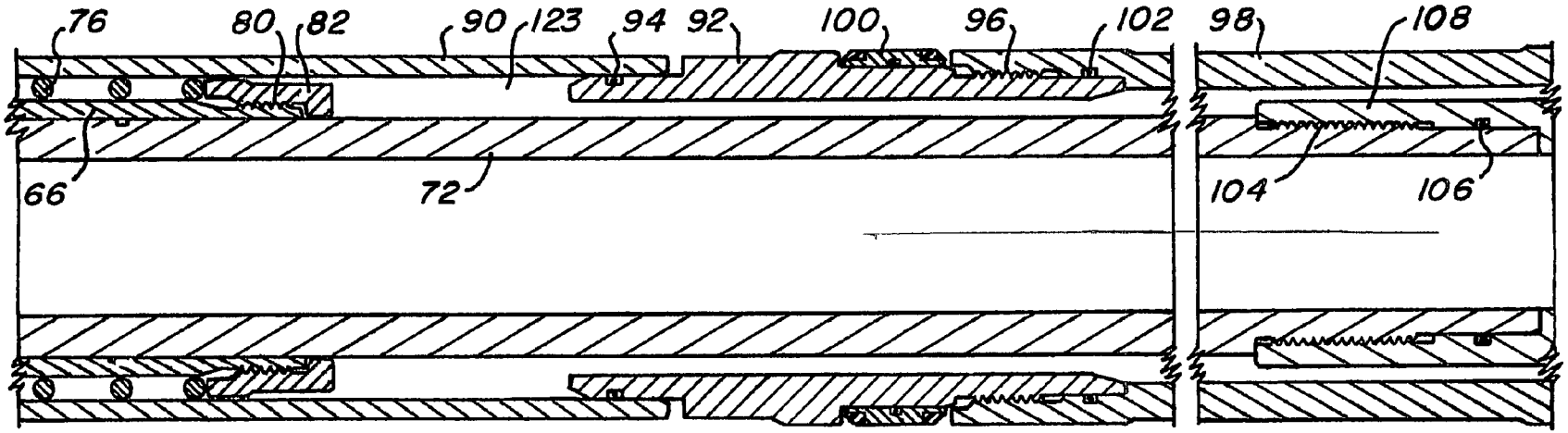
Figure 1E:
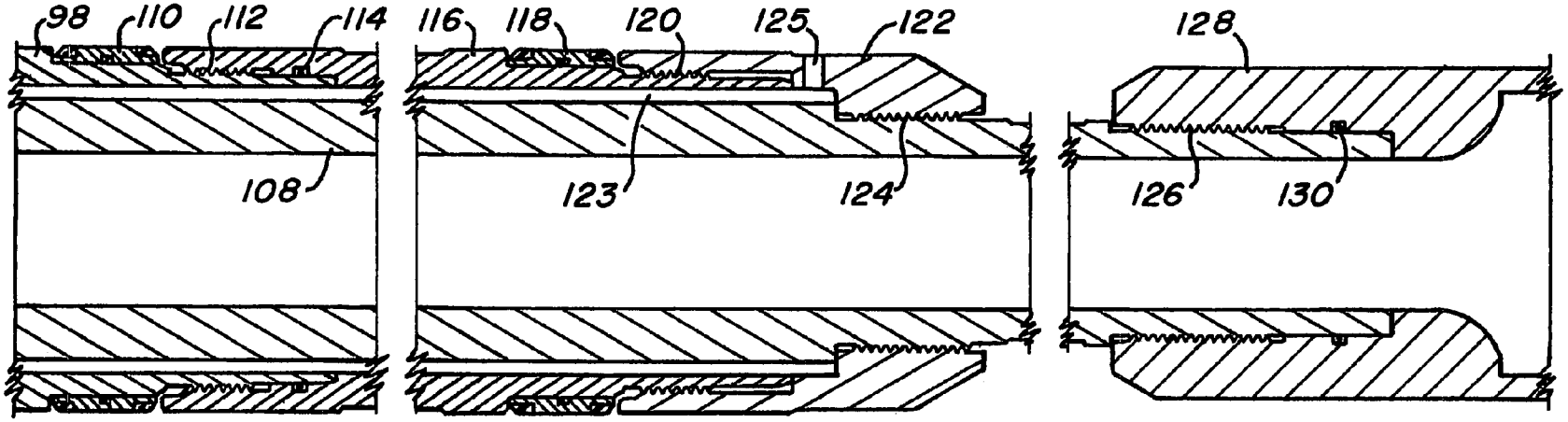
Figure 3A:
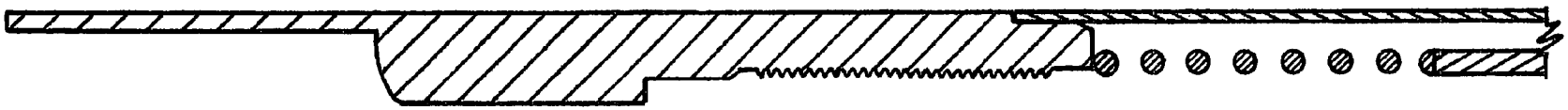
FIGS. 3A-3B are an extended view of a portion of the workstring of FIG. 1A-1E in a position for shifting a closing sleeve.
Figure 4A:
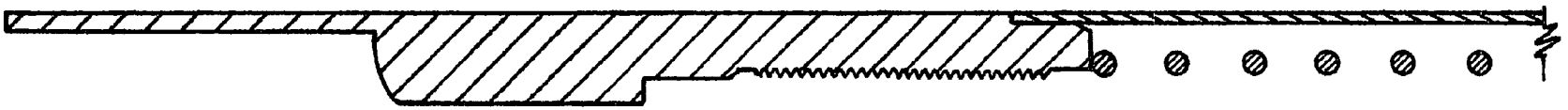
FIGS. 4A-4B are an extended view of a portion of the workstring of FIG. 1A-1E in a partial closure operation.
Figure 5A:
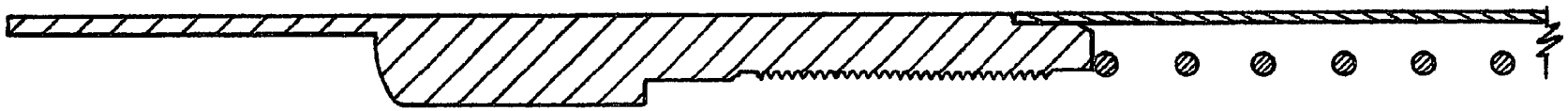
FIGS. 5A-5B are an extended view of a portion of the workstring of FIG. 1A-1E with ports closed and collet restricted.

In the following detailed description applicants have elected to describe the interconnection of all of the various components of this tool prior to discussing its operation. It is believed that once the components are identified the operation of the tool will be much more easily understood by one of ordinary skill in the art. It is important to point out that in the drawings only one pressure actuated valve and one closure mechanism are illustrated as part of the tool. One or more of these valves and closure mechanisms are contemplated as desired or needed for particular applications.

Figure 6A:
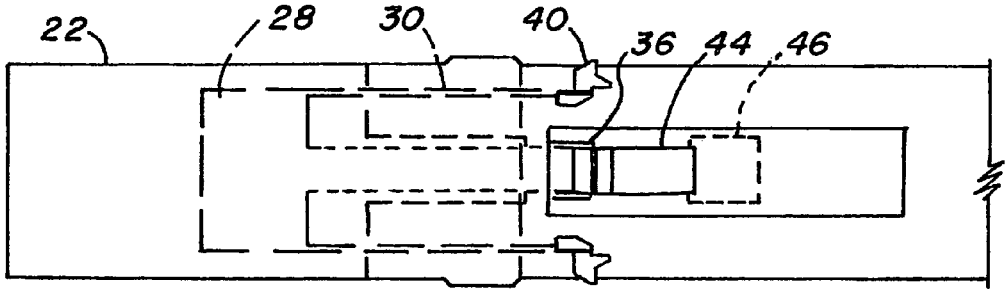
FIGS. 6A-6C are a family of depictions of the same components in progressive stages of activation.
Figure 6B:
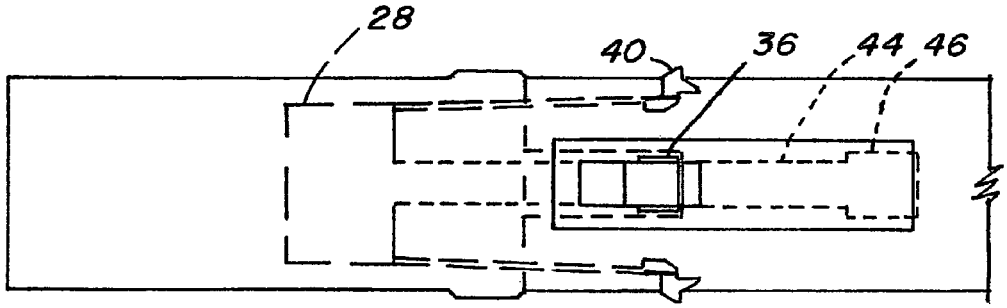
Figure 6C:
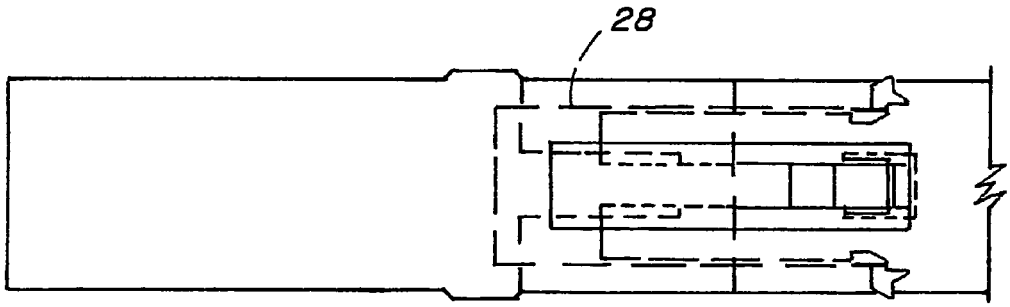
Figure 10:
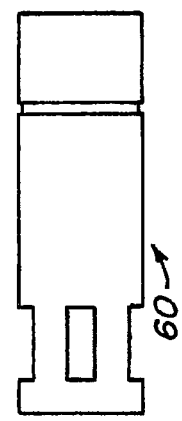
FIG. 10 is a side view of a closing sleeve divorced from other components.
Figure 9:
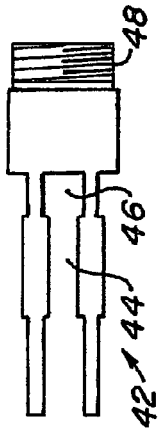
FIG. 9 is a side view of a ported connector divorced from other components.
Figure 7:
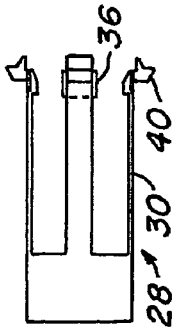
FIG. 7 is a side view of a collet as described herein.
Figure 8:
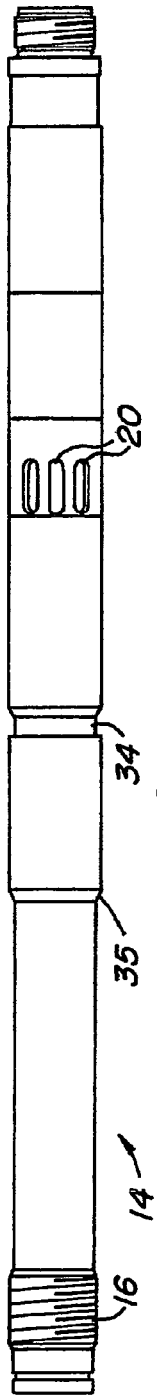
FIG. 8 is a side view of a ported mandrel divorced from other components.
Figure 12:
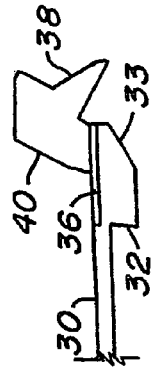
FIG. 12 is an enlarged view of a collet finger retaining feature in situ.
Figure 11:
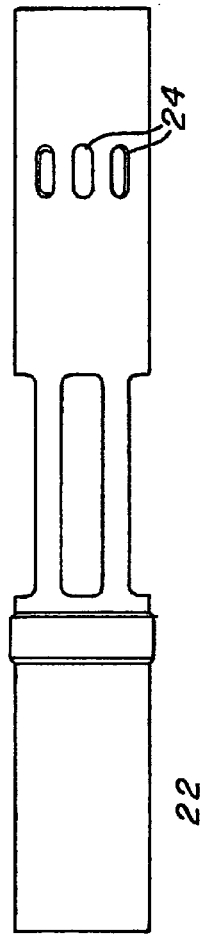
FIG. 11 is a side view of a ported housing divorced from other components.

For the identification portion of this application, reference to FIGS. 1A-1E will be sufficient. Additional reference to FIGS. 7-11 may be helpful. The tool 10 comprises a top sub 12 which is connected to a ported mandrel 14 at thread 16 and is sealed thereto by o-ring or other suitable seal 18. The ported mandrel includes ports 20 which are utilized to shorten the escape route of gravel slurry fluid as noted above. These ports are selectively used as will be discussed further hereinafter. Also connected to top sub 12 is a ported housing 22 having ports 24 which are aligned with mandrel ports 20 at all times during operation of this tool. Ported housing 22 is fixed connected to the top sub 12. A collet spring 26 bears against top sub 12 and against collet which collet includes a plurality of fingers 30, each of which has a plurality of features. More specifically, fingers 30 include a back angle 32 for engagement with the ported mandrel and recess 34 at the appropriate time. Further, fingers 30 include a pair of wings 36 functioning to allow passage at a certain time through other components of the tool and to maintain the tool in the locked position at other times during its operation. Finally, each finger 30 includes a closing feature 38 and a position retaining feature 40. A ported connector 42 is slidably received adjacent collet 28 and ported mandrel 14 in a position radially outward of each of those components. The ported connector 42 includes ports having specific opening configurations to ensure appropriate movement of collet 28. These ports include (see FIGS. 6A, 9 and 12) restrictive port 44 and opening port 46 where restricted port 44 is sized more narrowly than the outside dimension of wings 36 of collet fingers 30 and wherein opening port 46 is sufficiently large to allow passage of wings 36 through port 46. The ported connector 42 is connected via threaded connection 48 to opening sleeve 50. The opening sleeve 50 includes ports 52 and a plurality of o-ring seal grooves 54. The opening sleeve 50 is shear screwed to piston stop 56 at shear screw 58. Due to the proximity of the closing sleeve 60, it is appropriate to mention it now. The closing sleeve is defeatably retained by such as a shear member e.g., shear screw 62 to the ported housing 22.

At a downhole end of opening sleeve 50, that sleeve is threadedly connected at thread 64 to a piston mandrel 66 which mandrel includes a port 68. The mandrel further includes a way for a dog 70, which will snap out of engagement with an upper mandrel 72 at recess 77, to free a number of components to move downhole as will be described hereinafter. The dog 70 is initially maintained in contact with the upper mandrel 72 by a piston 74 which is pressure moveable against a piston spring 76. It is noted that piston 74 includes seal grooves 78. At a downhole end of piston mandrel 66, the mandrel is threadedly connected at thread 80 to a cap 82, which cap bounds spring 76 at an uphole end of piston mandrel 66 where it abuts opening spring 84 which is bounded at its uphole end by friction bearing 86. Friction bearing 86 is maintained in position by upper housing 88 which is connected to the ported housing 22 at its respective uphole end. At the downhole end of the upper housing 88 is connected a piston housing 90. At the downhole end of piston housing 90, the housing is sealed to an adapter sub 92 at a seal 94. At the downhole end of the adapter sub 92 that sub is connected via threaded connection 96 to a spacer seal sub 98 and further includes on the adapter sub, a bonded molded seal or other suitable seal 100. Spacer seal sub 98 is also sealed to adapter sub by seal 102. Previously mentioned upper mandrel 72 extends downhole to a threaded connection 104 and seal 106 with a lower mandrel 108 while spacer seal sub 98 includes at a downhole end thereof a bonded molded seal or other appropriate seal 110 and a threaded connection 112 and seal 114 which connects the spacer seal sub 98 to another spacer seal sub 116. At the downhole end of the second spacer seal sub 116 is in another seal which may be a bonded molded seal as in seal 110, that seal being identified by numeral 118. Spacer seal sub 116 is threadedly connected by thread 120 to bottom cap 122. Bottom cap 122 includes a port 125 open to annulus pressure. The port 125 is also in fluid communication with a passage 123 which extends uphole in the tool to a downhole end of piston 74. The bottom cap 122 is threadedly connected at thread 124 to lower mandrel 108 which itself is connected at a downhole end via thread 126 to a bottom sub 128. It is noted that a seal is provided at 130 between the lower mandrel 108 and the bottom sub 128.

Operation

Each of the components of the device having been identified, the operation of this device will now be described with reference to all figures. It is noted that initial operation of this device is similar to that disclosed in the above-identified '772 patent in that the first action of this tool is caused by a pressure rise due to the gravel packing operation. The pressure rise is "seen" at piston 74 at an uphole end thereof while a downhole end thereof "sees" pressure near the bottom of the tool through passage 123 and port 125, the piston 74 is urged against the biasing force of spring 76 in a downhole direction. Upon sufficient movement of piston 74 in the downhole direction, piston 74 will uncover dog 70 which then due to its construction will expand radially outwardly thereby removing it from contact with upper mandrel 72 at recess 77.

Figure 2A:
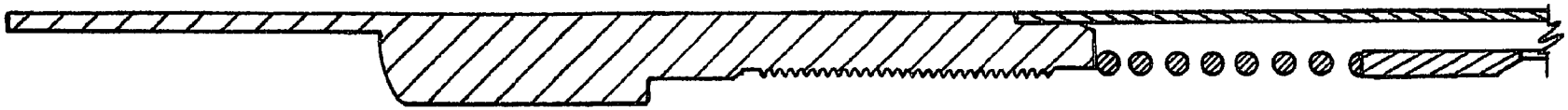
FIGS. 2A-2B are an extended view of a portion of the workstring of FIGS. 1A-1E in a locating position.
Figure 2B:
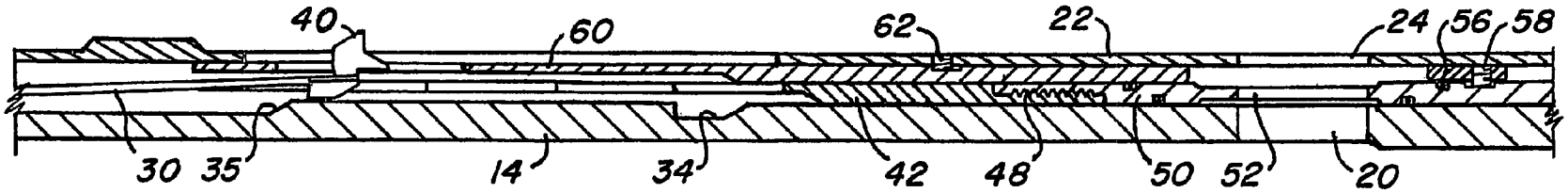
Figure 3B:
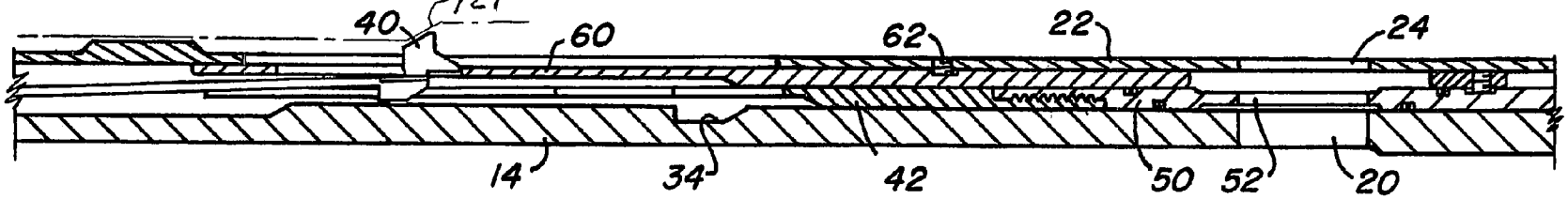
Figure 4B:
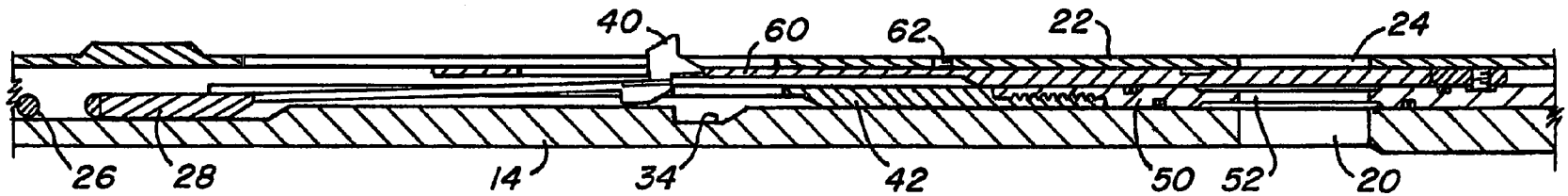
Figure 5B:
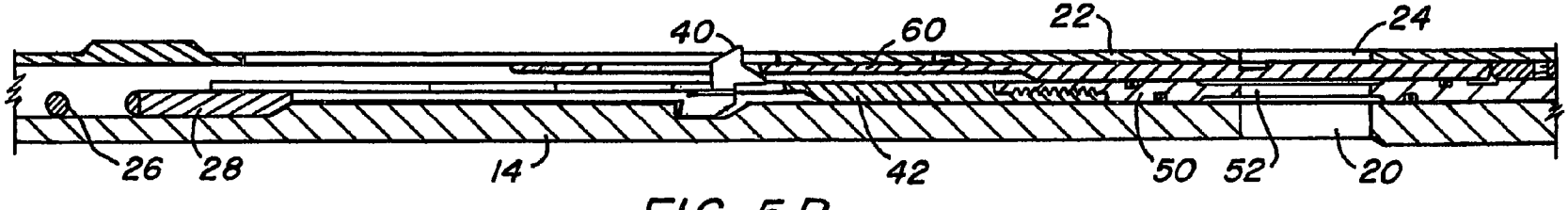

Once dog 70 has expanded out of contact with the groove in upper mandrel 72 there is nothing preventing the opening spring 84 from urging piston mandrel 66 downhole along with opening sleeve 50, and ported connector 42 due to the impetus of opening spring 84. This movement also allows collet spring 26 to urge the collet 28 downhole to drive the collet ramp 33 up ported mandrel incline 35 thereby driving each of the collet fingers 30 radially outwardly of their original position (note FIGS. 1B and 2B). It is noted that the relative position of the ported connector 42 and the collet fingers 30 is important to functionality of the tool due to the ports 44 and 46 as above described. In this condition, the ports 52 are now aligned (note distinction between FIGS. 1B and 2B-5B) with ports 20 from the ported mandrel 14 and 24 in the ported housing 22 thereby allowing fluid flow through the tool from an annular position proximate the gravel pack to the inside dimension of the tool 10. This is the shortened escape path for the fluid portion of the gravel slurry discussed hereinbefore. When the gravel packing operation is complete, it will then be desirable to close the through port 24, 52, 20 to the inside dimension of the tool. This operation relies upon closing sleeve 60 and the position retaining feature 40 of collet fingers 30. As is schematically illustrated in FIG. 3B, the position retaining feature 40 is sufficiently outwardly displaced by ramp 33 that the outside dimension of position retaining feature 40 is too large to fit through the seal bore restriction 127. Therefore, an uphole pull on tool 10 will move all components in the uphole direction that are not prevented from moving by position retaining feature 40. Those components prevented from moving by position retaining feature 40 include collet 28 and closing sleeve 60. Further pull in the uphole direction will cause the shear member, such as shear screw 62, to shear (note 2B and 3B) thereby allowing the closing sleeve 60 to close the ports 24, 52 and 20. While it is, in appearance, that the closing sleeve 60 is moving downhole in order to close these ports it is important to recognize that in fact the closing sleeve 60 is staying in position and the rest of the tool is moving uphole, the relative displacement of the items being identical. Before the full intended stroke in the uphole direction of the balance of the tool the downhole end of the closing sleeve 60 comes in contact with piston stop 56 (see FIG. 4B) and loads shear screw 58. At a selected load the shear screw 58 will shear allowing piston stop to move (See FIG. 5B) relative to the tool along with closing sleeve 60 such that as the tool moves uphole closing sleeve 60 and piston stop 56 are stationary. The relative downhole movement of closing sleeve 60 relative to opening sleeve 50 allows seal 54 to come in sealing engagement with closing sleeve 60, thus sealing closed ports 52. Following piston stop 56 and closing sleeve 60 reaching a final position, the movement of the ported mandrel 14 will have been sufficient to locate recess 34 directly radially inwardly of collet FIG. 30 allowing the collet fingers to snap back into an unactuated condition and to engage back angle 32 with the ported mandrel 14 (note distinction FIGS. 4B and 5B). This locked position enables two things, the first being that the closing sleeve 60 is locked closed and cannot be accidentally opened, and secondly that because the outside dimension of the collet fingers has now been retracted the workstring may be withdrawn from the wellbore.

It is important to note that the collet fingers 30 are designed specifically to yield in bending, stretching, breaking, shearing, etc. at a selected load greater than required for normal operation so that in the event debris becomes positioned radially inwardly of the fingers while they are expanded in their radial outward position the entirety of tool 10 will not be stuck in the hole requiring a major recovery effort. Rather, because the collet fingers are designed to yield as stated the workstring may be removed from the downhole environment even if the collet fingers do not snap back as they are intended to do. A pull from uphole will be sufficient to yield the collet fingers before damage to other components would result.

In the position in which the tool sits on conclusion of the foregoing discussion (FIGS. 5A-5B), it is ready to circulate a stimulation fluid to the bottom hole as all of the one or more flow ports that exists in the workstring are no longer open. One additional advantage of this system is that because the ports are all closed, the workstring does have pressure integrity and is therefore capable of inflating inflatables at the downhole end such as external casing packers, or any other function requiring applied hydraulic pressure, if desired.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A workstring for use in a gravel packing system, the workstring comprising:

a washpipe;

at least one port in the washpipe;

a selectively openable and closeable closure mechanism including a piston in operable communication with a first sleeve, the first sleeve being in operable communication with the at least one port, the at least one port being openable by the first sleeve upon axial movement of the piston in response to a pressure differential thereacross and closable by second sleeve upon axial movement of the workstring while the second sleeve is prevented from moving.

2. A workstring for use in a gravel packing system as claimed in claim 1 wherein the sleeve is mechanically actuable.

3. A workstring for use in a gravel packing system as claimed in claim 1 wherein the sleeve is pressure actuable.

4. A workstring for use in a gravel packing system as claimed in claim 1 further comprising:

a collet base;

at least one collet finger extending from the collet base;

a retaining feature on the at least one finger, the retaining feature being configured to plastically yield at a selected value.

5. A workstring for use in a gravel packing system as claimed in claim 4 wherein said yield is in bending.

6. A workstring for use in a gravel packing system as claimed in claim 4 wherein said collet is configured to catch on a selected feature in a wellbore such that the collet will be prevented from moving uphole while other items in the wellbore move uphole.

7. A workstring for use in a gravel packing system as claimed in claim 6 wherein said collet is further configured to prevent select elements from moving uphole while other items in the wellbore move uphole.

8. A workstring for use in a gravel packing system as claimed in claim 1 wherein the openable and closeable closure mechanism opens in response to the first sleeve moving in a first direction relative to the at least one port and the openable and closeable closure mechanism closes in response to the second sleeve moving in the first direction relative to the at least one port.

9. A workstring for use in a gravel packing system as claimed in claim 8 wherein the second sleeve is immobile in the first direction relative to the at least one port until the first sleeve has moved in the first direction relative to the at least one port.

10. A method for gravel packing comprising:

gravel packing a wellbore including:

moving a first sleeve with a piston with pressure differential thereacross as pressure associated with the gravel packing climbs;

opening one or more valves in a washpipe with movement of the first sleeve with the valves providing an escape path for a fluid component of the gravel pack to an inside dimension of the washpipe; and closing the one or more valves in the washpipe with a second sleeve by axially moving the washpipe while preventing movement of the second sleeve.

11. A method for gravel packing as claimed in claim 10 further comprising stimulating the well through the washpipe.

12. A method for gravel packing as claimed in claim 10 further comprising inflating an inflatable tool downhole through the washpipe.

13. A method for gravel packing as claimed in claim 10 further comprising conveying hydraulic pressure through the washpipe to control hydraulic operations.

14. A method for gravel packing as claimed in claim 10 wherein the closing is shifting the second sleeve to close the one or more valves.

15. A method for gravel packing as claimed in claim 14 wherein the shifting is accomplished mechanically.

16. A method for gravel packing as claimed in claim 14 wherein the shifting is accomplished hydraulically.

17. A method for gravel packing as claimed in claim 14 wherein the shifting is accomplished pneumatically.

18. A method for gravel packing as claimed in claim 14 wherein the shifting occurs by preventing movement of the second sleeve while moving other components of the washpipe.

19. A method for gravel packing as claimed in claim 18 wherein the other components are moving uphole.

20. A workstring for use in a gravel packing system, the workstring comprising:

a washpipe;

at least one port in the washpipe;

a selectively openable and closeable closure mechanism in operable communication with the at least one port;

a piston in operable communication with the closure mechanism to open the at least one port through movement of a first sleeve in response to pressure differential across the piston increasing during operation of the gravel packing system;

a second sleeve in operable communication with the closure mechanism to close the at least one port through movement washpipe without movement of the second sleeve; and a retaining feature upon a component of the workstring, the feature being plastically yieldable upon overpull from uphole.

* * * * *